US008085962B2

(12) United States Patent
Subramaniam et al.

(10) Patent No.: US 8,085,962 B2
(45) Date of Patent: Dec. 27, 2011

(54) AUDIO SYSTEM FOR PORTABLE DEVICE

(75) Inventors: Venkat Subramaniam, Framingham, MA (US); Jeffery P. Copeland, Framingham, MA (US); Daniel Harmon, Framingham, MA (US)

(73) Assignee: Bose Corporation, Framingham, MA (US)

( * ) Notice: Subject to any disclaimer, the term of this patent is extended or adjusted under 35 U.S.C. 154(b) by 1471 days.

(21) Appl. No.: 10/932,137

(22) Filed: Sep. 1, 2004

(65) Prior Publication Data

US 2006/0046780 A1 Mar. 2, 2006

(51) Int. Cl.
*H04R 1/02* (2006.01)
*G10K 11/16* (2006.01)

(52) U.S. Cl. ..... 381/332; 381/333; 381/334; 381/388; 381/71.7

(58) Field of Classification Search ..... 381/94.1, 381/118, 73.1, 306, 71.1, 71.2, 71.4, 71.7, 381/71.8, 59, 332–334, 388; 341/55
See application file for complete search history.

(56) References Cited

U.S. PATENT DOCUMENTS

| | | | | |
|---|---|---|---|---|
| 5,280,229 | A | 1/1994 | Faude | |
| 5,610,992 | A | 3/1997 | Hickman | |
| 5,689,574 | A | 11/1997 | Heirich et al. | |
| 5,732,145 | A | 3/1998 | Tsao | |
| 5,802,194 | A | 9/1998 | Yamagishi | |
| 5,881,989 | A * | 3/1999 | O'Brien et al. | 248/634 |
| 6,067,362 | A | 5/2000 | Lemanski et al. | |
| 6,173,064 | B1 | 1/2001 | Anagnos | |
| 6,255,800 | B1 | 7/2001 | Bork | |
| 6,275,595 | B1 | 8/2001 | Lundgren et al. | |
| 6,359,994 | B1 | 3/2002 | Markow | |
| 6,415,036 | B1 | 7/2002 | Ritter et al. | |
| 6,477,042 | B1 | 11/2002 | Allgeyer et al. | |
| 6,597,794 | B2 | 7/2003 | Cole et al. | |
| 6,694,200 | B1 | 2/2004 | Naim | |
| 6,741,717 | B2 | 5/2004 | Dedieu et al. | |
| 6,744,903 | B1 | 6/2004 | Jeon | |
| 2001/0001319 | A1 | 5/2001 | Beckert et al. | |
| 2001/0031059 | A1 | 10/2001 | Borgonovo | |
| 2001/0039200 | A1 | 11/2001 | Azima et al. | |
| 2002/0073252 | A1 | 6/2002 | Arbiter et al. | |

(Continued)

FOREIGN PATENT DOCUMENTS

EP 1 185 094 A2 3/2002

(Continued)

OTHER PUBLICATIONS

Apple imac g3, 2000, Apple (http://manuals.info.apple.com/en_US/iMacG3_2000UserManual.pdf).*

(Continued)

*Primary Examiner* — Devona Faulk
*Assistant Examiner* — George Monikang
(74) *Attorney, Agent, or Firm* — Fish & Richardson P.C.

(57) ABSTRACT

An audio system includes an enclosure having a transducer. The transducer creates a vibration in the enclosure in response to being driven by an audio signal having a frequency range. A cradle assembly mechanically couples a portable device to the enclosure through an isolator. A portion of the vibration is coupled into the cradle assembly. The isolator reduces an amplitude of the coupled vibration so that an operation of the portable device within a portion of the frequency range is uninterrupted when the portable device is coupled to the cradle assembly.

25 Claims, 10 Drawing Sheets

U.S. PATENT DOCUMENTS

| | | | | |
|---|---|---|---|---|
| 2002/0085730 | A1 | 7/2002 | Holland | |
| 2002/0115480 | A1 | 8/2002 | Huang | |
| 2002/0150261 | A1* | 10/2002 | Moeller et al. | 381/73.1 |
| 2002/0171567 | A1 | 11/2002 | Altare et al. | |
| 2003/0063767 | A1 | 4/2003 | Dedieu et al. | |
| 2004/0106454 | A1* | 6/2004 | Walker et al. | 463/42 |
| 2004/0204056 | A1 | 10/2004 | Phelps, III | |
| 2004/0234085 | A1 | 11/2004 | Lennox | |
| 2005/0018839 | A1 | 1/2005 | Weiser | |
| 2005/0244025 | A1 | 11/2005 | Schul et al. | |
| 2005/0255895 | A1 | 11/2005 | Lee et al. | |
| 2006/0013411 | A1 | 1/2006 | Lin | |
| 2006/0134959 | A1 | 6/2006 | Ellenbogen | |
| 2006/0181840 | A1 | 8/2006 | Cvetko | |
| 2006/0250764 | A1 | 11/2006 | Howarth et al. | |
| 2006/0253879 | A1 | 11/2006 | Lin | |
| 2007/0002533 | A1 | 1/2007 | Kogan et al. | |
| 2007/0014426 | A1 | 1/2007 | Sung | |
| 2007/0035917 | A1 | 2/2007 | Hotelling | |

FOREIGN PATENT DOCUMENTS

| | | |
|---|---|---|
| EP | 1 527 801 | 5/2005 |
| EP | 1 635 607 A | 3/2006 |
| WO | WO 2005/104655 | 11/2005 |

OTHER PUBLICATIONS

Steve Guttenberg, "Altec Lansing InMotion," Internet Citation [Online] Jun. 10 2004 (downloaded Nov. 11, 2006) URL: http://reviews.cnet.com/4505-7869_7-30790793.html.

International Search Report for corresponding application PCT/US2008/063563, dated Aug. 18, 2008.

www.altecmm.com, Oct. 2003, inMotion portable audio stereo.

www.pcstats.com, Jun. 21, 2004, NoiseControl Novibes III HDD Isolation.

vvww.reviews.cnet.com, Jul. 23, 2004, Creative Travel Sound.

www.jbl.com, Jul. 23, 2004, Harman Multimedia Onstage.

www.earsc.com, Jun. 28, 2004, Stereo Speaker.

Chinese Office Action in counterpart Application No. 200510099613.6 dated Aug. 3, 2010, 16 pages.

* cited by examiner

AUDIO SYSTEM FOR PORTABLE DEVICE

BACKGROUND OF THE INVENTION

Portable electronic devices for listening to high-quality audio have become smaller and lighter over the past number of years. Earphones are generally used to listen to the audio, but some portable electronic devices can include small internal speakers. Many portable electronic devices also include an output port for connecting the portable electronic device to a stereo system or to external speakers through a flexible cable.

SUMMARY OF THE INVENTION

In one aspect, the invention relates to an audio system that includes an enclosure. A transducer is mounted to the enclosure and creates a vibration in the enclosure in response to being driven by an audio signal having a frequency range. The audio system also includes a cradle assembly that mechanically couples a portable device to the enclosure through an isolator. A portion of the vibration is coupled into the cradle assembly. The isolator reduces an amplitude of the coupled vibration so that an operation of the portable device within a portion of the frequency range is uninterrupted when the portable device is coupled to the cradle assembly.

The operation of the portable device can include an audio playback, accessing data from a memory, accessing data from a disk drive, recording data to a memory, recording data to a disk drive, recharging a battery, or any other function of the portable device. The portable device can include an MP3 device, a mini-disk device, a compact disk (CD) device, a personal digital assistant (PDA), a palmtop computer, a cellular telephone, a digital camera, or a pager, for example. Other types of portable devices can also be used. The portable device can include a disk drive. The portable device can include a portable audio player.

The enclosure can include an acoustic port, an acoustic waveguide, a passive radiator, an acoustic insulator, and/or an acoustic dampening device. The enclosure can also include one or more feet.

The audio system can also include a remote control receiver and a remote control transmitter that communicates with the remote control receiver through a wireless communication link. The remote control transmitter can include control buttons that are mapped to control buttons on the portable device.

The isolator can be an elastomer member, a spring, a foam member, a cork member, a dashpot, a shock absorber, a hydraulic system, a cushion, a grommet, a bushing, or any other device that isolates and/or dampens vibration.

The cradle assembly can include a connector that connects the portable device to the transducer. The connection can be made through an amplifier. The cradle assembly can also include an insert that is shaped to accept a chassis of the portable device. The cradle assembly can also include an elastomer member that isolates a chassis of the portable device from the cradle assembly. The cradle assembly can also include one or more feet.

The portion of the frequency range of the audio signal can be between about 10 Hz and 800 Hz or between about 1200 Hz and 20 kHz.

The audio system can also include a processor. The processor can include a gain cell and/or a notch filter that modifies a gain of predetermined frequencies in the audio signal. The notch filter can be tuned to one or more predetermined frequencies in the audio signal that correspond to vibrations in the enclosure that can interrupt the operation of the portable device. The processor can be coupled to an interface module that modifies a signal from the portable device and transmits the modified signal to the processor. The processor can also increase a gain of the audio signal in predetermined increments when the portable device is coupled to the audio system. The processor can preset an equalization parameter of the portable device to a predetermined setting.

In another aspect, the invention relates to a method for transmitting audio from an audio system. The method includes generating an audio signal having a frequency range with a portable device. The portable device is mechanically coupled to an enclosure of the audio system through an isolator. The method further includes transmitting the audio signal to a transducer that is mounted to the enclosure. The transducer creates a vibration in the enclosure in response to being driven by the audio signal. A portion of the vibration is coupled into the portable device. The isolator reduces an amplitude of the coupled vibration so that an operation of the portable device within a portion of the frequency range is uninterrupted when the portable device is coupled to the cradle assembly.

The portable device can include a disk drive and the isolator can substantially prevent an operation of the disk drive from being interrupted by the vibration in the enclosure.

The method can also include modifying the audio signal generated by the portable device and transmitting the modified audio signal to the transducer. The method can also include modifying a gain of one or more predetermined frequencies in the audio signal. The method can also include controlling a function of the portable device with a remote control transmitter.

In another aspect, the invention relates to a method for manufacturing an audio system for a portable device. The method includes mounting a transducer to an enclosure in the audio system. The transducer creates a vibration in the enclosure in response to being driven by an audio signal having a frequency range. The method also includes mounting a cradle assembly to the enclosure through an isolator such that a portion of the vibration is coupled into the cradle assembly. The isolator reduces an amplitude of the coupled vibration so that an operation of the portable device within a portion of the frequency range is uninterrupted when the portable device is coupled to the cradle assembly.

The method can also include adding an acoustic port, an acoustic waveguide, a passive radiator, an acoustic insulator, and/or an acoustic dampening device to the enclosure. The method can also include mounting a receiver to the enclosure. The receiver can control a function of the portable device. The method can also include forming an insert in the cradle assembly to support the portable device. The method can also include processing an audio signal from the portable device.

In another aspect, the invention relates to a method for minimizing an effect of a vibration on a portable device in an audio system. The method includes mounting a transducer to an enclosure in the audio system. The method also includes transmitting an audio signal having a frequency range to the transducer to generate acoustic energy from the transducer. A portion of the acoustic energy creates the vibration in the enclosure. The method also includes mounting a cradle assembly to the enclosure through an isolator such that a portion of the vibration is coupled into the cradle assembly. The isolator reduces an amplitude of the coupled vibration so that an operation of the portable device within a portion of the frequency range is uninterrupted when the portable device is coupled to the cradle assembly.

The operation of the portable device can include audio playback, accessing data from a memory, accessing data from a disk drive, recording data to a memory, recording data to a disk drive, recharging a battery, and/or any other function of the portable device.

The method further includes mounting a receiver to the enclosure. The receiver receives a signal that controls a function of the portable device. The enclosure can also include an acoustic port, an acoustic waveguide, a passive radiator, an acoustic insulator, and/or an acoustic dampening device. The method can also include forming an insert in the cradle assembly to support the portable device. The method can also include coupling an amplifier to the transducer. The amplifier amplifies the audio signal. The audio signal can also be processed by a processor.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

A portable electronic device, such as a portable audio device, typically includes an internal storage device for storing data. The storage device can be an internal memory chip, a removable memory card, or a hard disk drive (HDD), or other rotating media storage devices such as CD or DVD drives, for example. Hard disk drive-based portable devices are advantageous because a large amount of data can be stored on them.

However, hard disk drives can be more sensitve to shock and vibration than other storage devices. Even relatively small shocks or vibrations can interrupt the operation of the hard disk drive by causing the read head of the hard drive to disengage from the platter containing the data. A sufficiently large shock can cause the read head to crash into the platter and can damage the drive.

This has led some manufacturers to integrate a memory buffer into their portable devices in order to provide an uninterrupted audio data stream to the user in the event of an interruption in the operation of the hard disk drive. Some memory buffers can store several minutes of audio data. The hard disk drive loads the audio data into the memory buffer. When the portable device experiences shock or vibration that momentarily interrupts the operation of the hard disk drive, the memory buffer continues to supply uninterrupted audio data to the portable device. The hard disk drive replenishes audio data into the memory buffer once the vibrations or shocks cease. If the rate of recurrence of the vibrations is too great and the hard disk drive remains in the interrupted state, the memory buffer will eventually discharge the buffered audio data and the user will experience an interruption in the stream of audio data. In another more common scenario, the hard disk drive can be in an interrupted state when the memory buffer requests additional audio data. Since the hard drive cannot provide the additional audio data, the user experiences an interruption in the stream of audio data from the portable device. Skilled artisans will appreciate that the following description is generally applicable to any portable device having an storage device such as a rotating media drives and not just hard disk drive-based portable devices.

Figure 1:
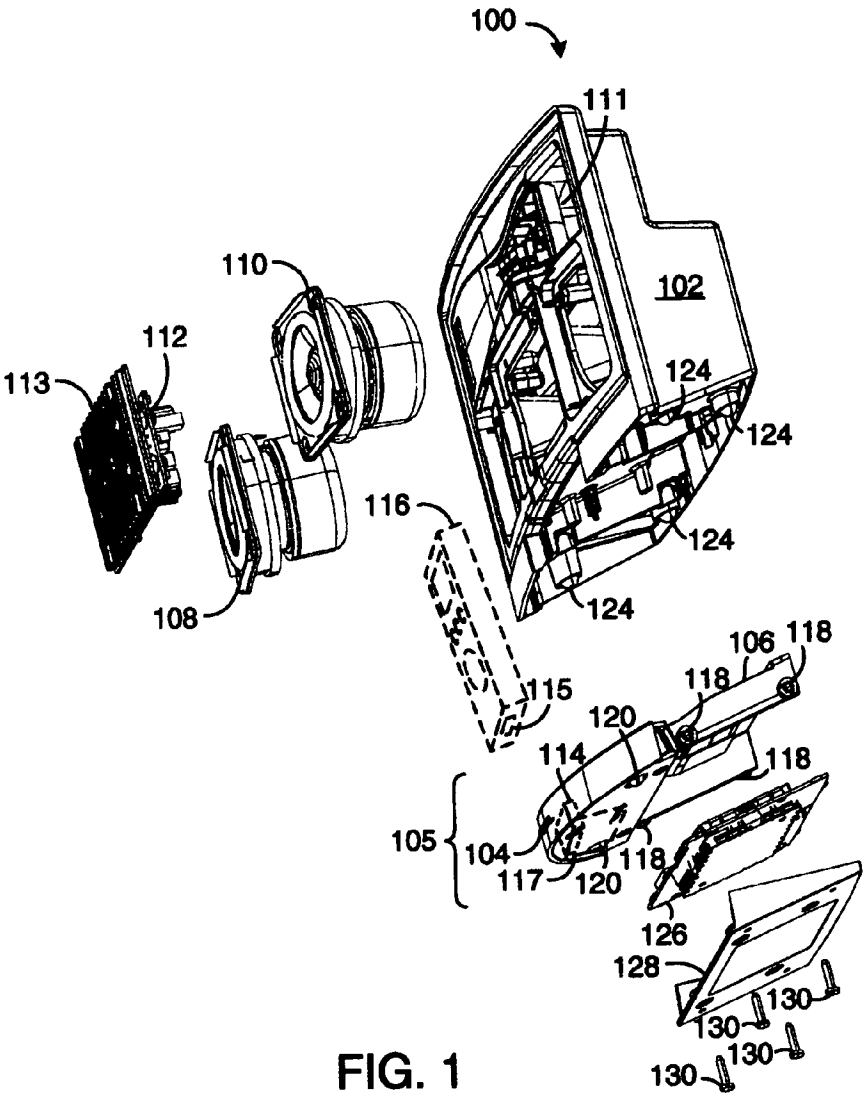
FIG. 1 is an exploded perspective view of an audio system according to the invention.

FIG. 1 is an exploded perspective view of an audio system 100 according to the invention. The audio system 100 includes an enclosure 102, a cradle 104, and a chassis 106 of the cradle 104. The docking station 100 also includes a first 108 and a second electroacoustic transducer 110. In one embodiment, the enclosure 102 is a ported enclosure having a port 111 that is tuned to a desired frequency. The enclosure 102 can also include additional ports, acoustic waveguide structures, passive radiators, acoustic insulators, acoustic dampening material and/or any other features that can improve the acoustic performance of the audio system 100.

An amplifier 112 is mounted to the enclosure 102. The amplifier 112 can include a heatsink 113 or other cooling mechanism to dissipate heat from the amplifier 112. In one embodiment, the amplifier 112 is a two-channel amplifier. The amplifier 112 can also be a single-channel amplifier or a plurality of single-channel amplifiers. The amplifier 112 is electrically connected to the transducers 108, 110 and is adapted to amplify audio signals that are supplied by a portable device 116. The portable device 116 can include an MP3 device, a mini-disk device, a compact disk (CD) device, a personal digital assistant (PDA), a palmtop computer, a cellular telephone, a digital camera, or a pager, for example.

The enclosure 102 also includes a screen (not shown) or a grill that covers and protects the transducers 108, 110. The screen can be fabricated from a fabric, a foam, a plastic, or a metal material. The screen can be removable or can be permanently mounted to the enclosure 102.

The cradle, 104 can include an insert that is shaped to accept a chassis of the portable device 116. The insert can be different shapes and site depending on the specific portable device. The cradle 104 also includes a connector 114 that is mechanically coupled to the chassis 106 of the cradle 104 through a circuit board 117. The circuit board 117 is mounted to the chassis 106 of the cradle 104 with screws or other mounting hardware. In one embodiment, the cradle 104, the connector 114, and the circuit board 117 are integrated into a cradle assembly 105 having a chassis 106. The chassis 106 of the cradle assembly 105 is mechanically coupled to the enclosure 102 of the audio system 100 through one or more isolators 118. The isolators 118 can include elastomer members, springs, foam members, cork members, dashpots, shock absorbers, hydraulic systems, cushions, grommets, or bushings, for example. The connector 114 is adapted to mate with a connector 115 of the portable device 116. In one embodiment, the connector 114 and the cradle 104, which can form the cradle assembly 105, are mechanically coupled to the enclosure 102 of the audio system 100 through the isolators 118 such that the connector 114 and the cradle 104 are substantially vibrationally isolated from the enclosure 102.

The chassis 106 of the cradle assembly 105 also includes one or more feet 120 that are positioned to support the cradle 104 including the connector 114 when the audio system 100 is placed on a surface, such as a table or a shelf. The number, type, and position of the feet 120 that are used is determined by attributes of the system, such as the spectrum of mechanical energy present in the structure, the design of the structure, material properties of elements in the structure, etc.

The enclosure 102 of the audio system 100 also includes a plurality of feet 124 that are positioned to support the audio system 100 when it is placed on the surface. The feet 124 can be symmetrically positioned on the underside of the enclosure 102, for example. Parameters of the audio system 100, such as its size and weight, are used to determine the number and the position of the feet 124 that support the audio system 100.

The audio system 100 can also include an audio signal processor 126, such as a digital signal processor (DSP). The audio signal processor 126 can perform signal processing on the audio signal generated by the portable device 116. For example, the audio signal processor 126 can execute any known sound processing algorithms which may include: sound equalization, digital crossover, bass, treble, volume, surround sound, Dolby pro-logic™, AC-3 and MPEG decoding, or other signal processing functions. Other functions of the DSP 126 are described in more detail herein with reference to FIG. 4. A mounting bracket 128 secures the DSP 126 to the underside of the cradle 104 with four screws 130. In some embodiments, the mounting bracket 128 can secure the DSP 126 with glue, press-fit, or any other mounting system. The DSP is generally mounted on a PCB. The PCB can be the same PCB that includes the connector, or it can be a different PCB, depending on how the system is configured.

Figure 2:
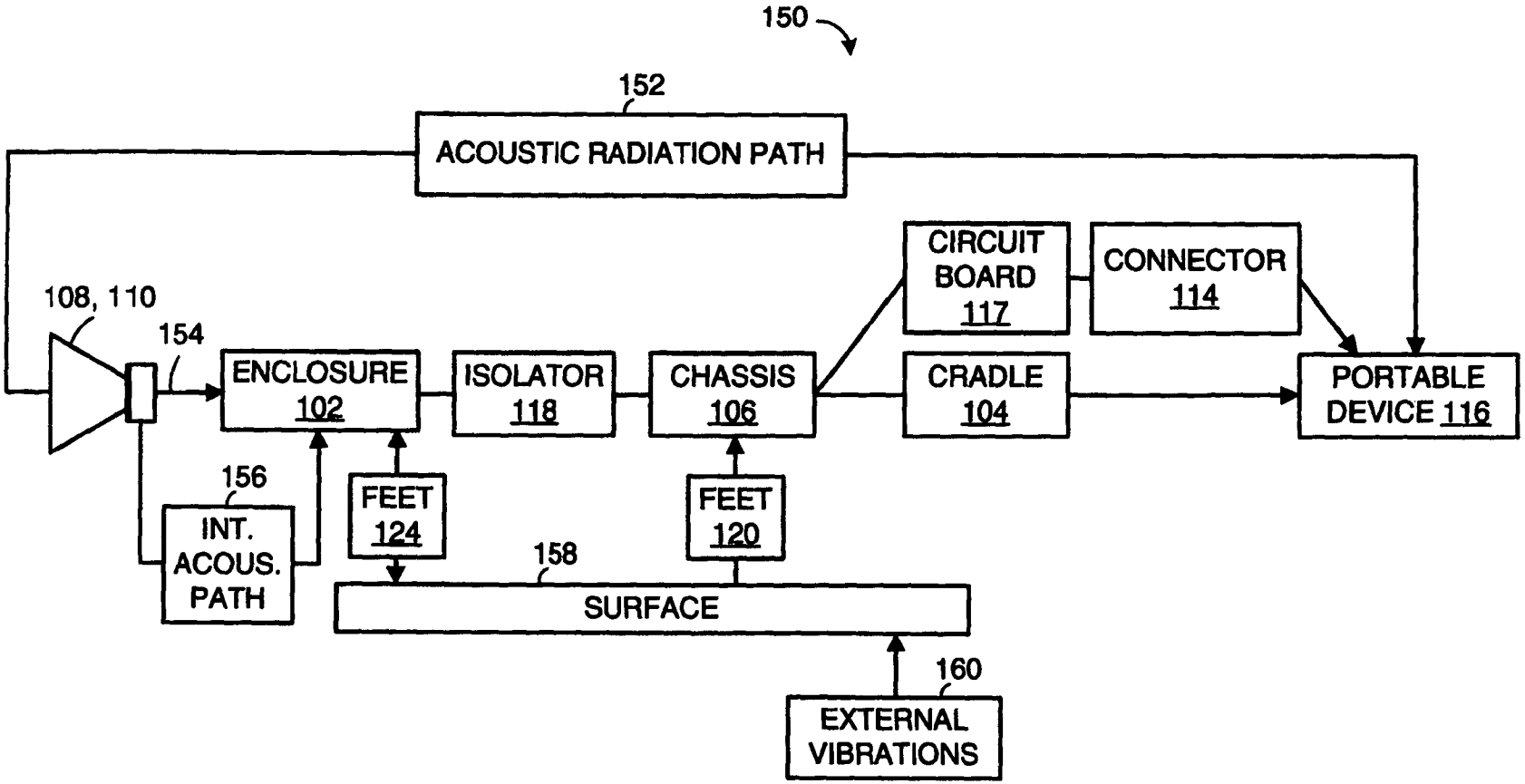
FIG. 2 illustrates a block diagram of the transmission path of vibrations in the audio system of FIG. 1.

FIG. 2 illustrates a block diagram of the transmission path 150 of mechanical vibrations in the audio system 100 of FIG. 1. The vibrations that can affect the portable device 116 in the audio system 100 can be separated into three distinct paths. In one embodiment, methods according to the invention can isolate a large component of the vibtrations before they are transmitted into the portable device 116. In another aspect, any vibrations that are not substantially isolated can be dampened or attentuated before they affect the operation of the portable device 116. Thus, the path of the vibrations is interruped and/or attenuated by isolators or dampeners before the vibrations can affect an operation of the portable device 116. Skilled artisans will appreciate that the number and the position of isolators or dampeners in the vibration paths can be varied depending on the requirements of the particular audio system.

The first vibration path 152 is generated by the acoustic output of the transducers 108, 110 in the form of sound waves. The first path 152 typically has a small effect on the operation of the portable device 116. Thus, the portable device 116 is generally not isolated from the acoustic output of the transducers 108, 110. Skilled artisans will appreciate that various techniques can be used to minimize the effect from the acoustic output of the transducers 108, 110 on the operation of the portable device 116, such as modifying the acoustic radiation pattern of the transducers 108, 110, such that relavtively less acoustic energy is radiated towards the portable device than is radiated out to the listening location.

The second vibration path 154 is generated by the mechanical movement of the transducers 108, 110 in the enclosure 102. The second vibration path 154 can have a large effect on the operation of the portable device 116 and is described in more detail herein. The enclosure 102 can also experience vibrations generated from within the enclosure 102 from an internal acoustic vibration path 156. The internal acoustic vibration path 156 is created by the acoustic output of the transducers 108, 110 within the enclosure 102. Pressure variations generated within the enclosure exert forces on the enclosure walls, which then induce vibrations in the enclosure structure.

The enclosure 102 is mechanically coupled to a surface 158 by the feet 124. The feet 124 are designed to attenuate vibrations that emanate from the enclosure 102 before they are transmitted into the surface 158. The feet 124 can also attenuate vibrations that emanate from the surface 158 before they are transmitted into the enclosure 102.

In one embodiment, the second vibration path 154 is interrupted by one or more of the isolators 118. The isolators 118 are positioned between the enclosure 102 and the chassis 106 of the cradle 104. The isolators 118 are designed to prevent the vibrations of the enclosure 102 from coupling into the chassis 106 of the cradle 104. The isolators 118 isolate the chassis 106 from the enclosure 102 and attentuate vibration before it can affect the operation of the portable device 116.

The chassis 106 also includes the feet 120. The feet 120 are designed to attenuate vibrations that can emanate from the surface 158, such as from the enclosure 102 through the feet 124, or from an external source 160 that is coupled to the surface 158.

The connector 114 is rigidly mounted to the circuit board 117 through a solder connection, for example. The circuit board 117 is rigidly mounted to the chassis 106 using mounting hardware, such as screws. In one embodiment, the circuit board 117 can be mounted to the chassis 106 through isolators (not shown) to further isolate the connector 114 from vibrations emanating from the enclosure 102 and emanating from the surface 158. The portable device 116 is mechanically and electrically coupled to the connector 114. In one embodiment, the connector 114 is mechanically isolated from the circuit board 117 through isolators.

The portable device 116 is also mechanically coupled to the cradle 104. The cradle 104 provides physical support to the portable device 116 when it is seated onto the connector 114. The cradle 104 can include a compressible elastomer that compresses when the portable device 116 is seated in the cradle 104. The compressible elastomer can isolate and/or dampen vibrations in the cradle before they propagate into the case of the portable device 116. In one embodiment, the cradle 104, circuit board 117, and the connector 114 (i.e., the cradle assembly) are integrated with the chassis 106. The cradle 104 can also be mechanically isolated from the chassis 106 using one or more isolators.

Figure 3:
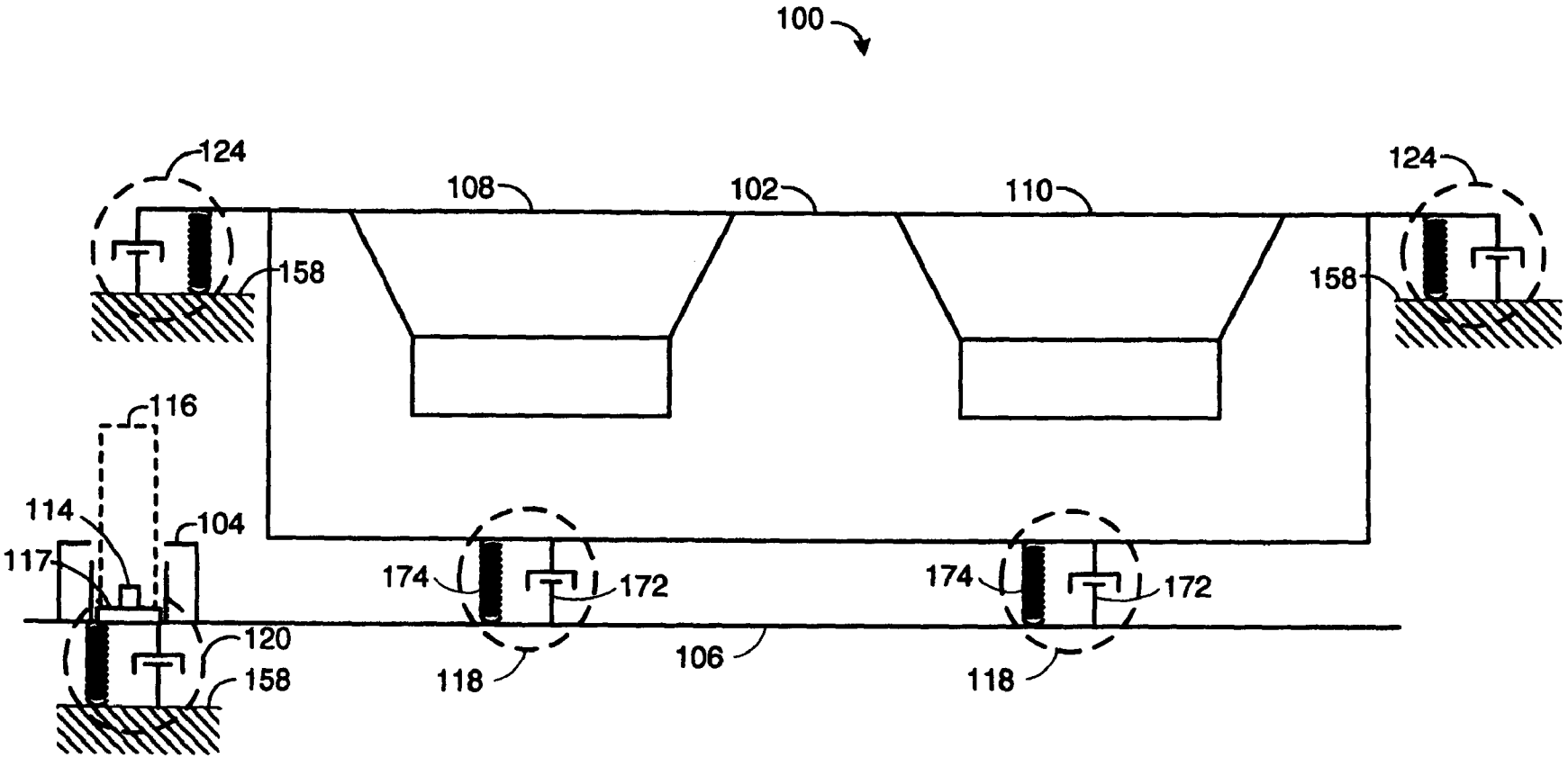
FIG. 3 illustrates a schematic diagram of the audio system of FIG. 1.

FIG. 3 illustrates a schematic diagram of the audio system 100 of FIG. 1. The audio system 100 includes the enclosure 102 and the cradle 104. The chassis 106 of the cradle 104 is mechanically coupled to the enclosure 102 through the isolators 118. In other embodiments, the chassis 106 of the cradle 104 can be coupled to the enclosure 102 through rigid, resistive, elastic, or compliant coupling. The enclosure 102 is shaped to include the electroacoustic transducers 108, 110.

The electroacoustic transducers 108, 110 are generally rigidly mounted to the enclosure 102. In one embodiment, the enclosure 102 is a ported enclosure. The ported enclosure can be tuned to a desired resonant frequency. The enclosure 102 can include any number of acoustic ports, passive radiators, acoustic waveguide structures, acoustic insulators, and acoustic dampening material.

In one embodiment, the transducers 108, 110 are mounted into apertures in the enclosure 102 using screws or other mounting hardware. A gasket or other sealing device can be placed between a basket or frame of each of the transducers 108, 110 and its corresponding aperture in the enclosure 102.

The cradle 104 includes the connector 114 that is shaped to connect to the portable device 116. The cradle 104 and the connector 114 together can form a cradle assembly. The technical description, including the pin-outs of the connector 114, is described in more detail herein with reference to FIG. 4. The connector 114 is mechanically coupled to the chassis 106 of the cradle 104. In one embodiment, the connector 114 is coupled to an intermediate structure, such as a circuit board 117, which is then coupled to the chassis 106. Also, the connector 114 could be mechanically coupled directly to the cradle 104. The cradle 104 generally surrounds the connector 114. The connector 114 can be integrated with the cradle 104 or molded into the cradle 104 and the cradle assembly can be coupled to the enclosure 102 through the isolators 118.

The cradle 104 and the connector 114 can be exchanged with other cradles and connectors to allow a variety of portable devices to be used with the audio system 100. The circuit board 117 can also be exchanged with a circuit board having different interface circuitry or a different connector. For example, a hard disk drive-based audio player can have a different interface connector and require a different cradle than a cellular telephone or a personal digital assistant (PDA). In these cases, a different cradle 104 and/or a different connector 114 and possibly interface electronics can be used depending on the type and brand of the device. The shape and size of the cradle 104 are generally variable to accommodate a variety of portable devices 116. In one embodiment (not shown), the cradle 104 is designed to vary its shape and size to accommodate a variety of portable devices.

The docking station 100 includes the isolators 118 that vibrationally isolate the connector 114 and the cradle 104 from the enclosure 102. By "vibrationally isolate" we mean that a large portion of the vibrations or oscillations that emanate from the enclosure 102 are substantially interrupted or filtered by the isolators 118 before propagating to the cradle 104 and the connector 114 and ultimately to the portable device 116. The isolators 118 essentially place mechanical filters in the transmission path (from source to device) of the mechanical energy. Isolators 118 can be springs, or may be combinations of springs and masses. Mechanically resistive filter elements can also be incorporated (i.e., dampening elements). The filter elements can be separate elements, or dampening may be incorporated in an element such as a spring. Elastomer members can also be incorporated and can be modeled as a combination of a mechanical spring and a mechanical resistance.

By "dampening" we mean that the mechanical energy is attenuated. Dampening implies the dissipation of energy (mechanical in this case). Generally the dissipation is in the form of heat. The attenuation of transmitted vibrations can occur because of dampening or filtering. Filtering essentially changes the mechanical impedance of the structure. Thus, a mechanical filter positioned between the source and a portion of the structure can substantially prevent mechanical energy from transferring from the source into the portion of the structure that is separated from the source by the mechanical filter.

The corner frequency of the mechanical filter (assuming a mechanical low pass filter topology) is typically chosen to be as low in frequency as practical, so that it is below the frequency range where the vibration energy is expected to exist. Higher order filters can be used if desired. However they are generally more expensive and the behavior of higher order systems around the cutoff frequency is typically more difficult to control.

The isolators 118 can be springs, elastomer members, foam members, cork members, dashpots, shock absorbers, hydraulic systems, cushions, grommets, bushings, or any device that suitably isolates and attenuates vibrations or oscillations. The isolators 118 are illustrated in FIG. 3 as a combination of a damper 172 and a spring 174 in a parallel configuration. The isolators 118 can also be described as a combination of a damper and a spring in a series configuration (not shown). The isolators 118 are positioned between the enclosure 102 and the chassis 106 in the embodiment shown in FIG. 3. However, skilled artisans will appreciate that the isolators 118 can be positioned in other locations without departing from the invention. For example, one or more isolators 118 can be positioned between the circuit board 117 and the chassis 106.

In some embodiments, the isolators 118 are grommets that are fabricated from rubber, elastomer, or silicon material. The isolators 118 can be fabricated from a urethane compound that exhibits good damping characteristics and stable material properties over a broad temperature range. For example, the isolators 118 can be fabricated from a product called VersaDamp™ from E-A-R specialty composites, a division of Aearo Company. The mass and size of the portable device 116, as well as the shear and compressive loading encountered from connecting the portable device 116 to the connector 114, influence the number, position, and type of isolators 118 that are used.

The enclosure 102 of the audio system 100 can also include one or more feet 124 that are positioned to support the audio system 100 when it is placed on the surface 158. For example, the surface 158 can be a top surface of a table or a shelf. The feet 124 can be fabricated from a rubber, elastomer, or silicon material. In one embodiment, the feet 124 are fabricated from a rubber compound that is available from 3M™ Company. The feet 124 are mechanically coupled to the enclosure 102 of the audio system 100 and are positioned so as to isolate the vibrations that propagate from the enclosure 102 to the surface 158. The feet 124 can also dampen any vibrations from the enclosure 102 to the surface 158. In one embodiment, the feet 124 are essentially similar to the isolators 118. They can also be described as mechanical filters. The feet 124 can function in a manner that is similar to the function of the isolators 118.

The chassis 106 of the cradle 104, which is mechanically coupled to the connector 114, can also include one or more feet 120 that are adapted to support the cradle 104 when the audio system 100 is placed on the surface 158. The feet 120 are designed to support the combination of the cradle 104, the connector 114, and the portable device 116 so that the isolators 118 that couple the chassis 106 to the enclosure 102 remain in a substantially desirable state of compression. In one embodiment (not shown), the chassis 106 of the cradle 104 does not include the feet 120 and the isolators 118 support the combination of the cradle 104, the connector 114, and the portable device 116. The feet 120 can be fabricated from a rubber, elastomer, or silicon material. In one embodiment, the feet 120 are fabricated from a rubber compound that is available from 3M™ Company.

The feet 120 can attenuate vibrations that emanate from the enclosure 102 and travel through the surface 158 before they propagate to the chassis 106 of the cradle 104 and ultimately into the portable device 116. The feet 120 form a mechanical filter (typically a low pass filter) that filters out mechanical energy that can propagate from the enclosure 102 to the surface 158, or from the surface 158 through the cradle 104 and into the portable device 116. In this embodiment, the feet 124 and 120 can operate in combination to provide isolation or attenuation of vibration energy that can propagate from the enclosure 102 through the surface 158 to the chassis 104. In one embodiment, the feet 120 can also substantially attenuate vibrations emanating from external sources 160 (FIG. 2) that are in contact with the surface 158.

The docking station 100 operates as follows. The portable device 116 is placed in the cradle 104 and is seated onto the connector 114. The portable device 116 is activated and an audio track is selected. A remote control unit (not shown) can be used to select the audio track and/or to control the volume. The remote control unit can control a variety of functions including sound equalization and stereo balance, for example. The connector 114 receives audio data corresponding to the selected audio track. The audio data is processed by a processor (not shown) in the docking station 100. For example, the processor can include an amplifier that amplifies the audio data and/or an audio signal processor that performs sound processing such as sound equalization. The audio signal processor can be a digital signal processor (DSP) that performs analog-to-digital conversion, for example. The audio data drives the transducers 108, 110 that are mounted in the enclosure 102.

The transducers 108, 110 produce sound by vibrating and disturbing the air around them, thereby creating acoustic energy. The movement of the transducers 108, 110 when they are producing the sound creates airborne energy and mechanical energy. The combination of the acoustic and mechanical energy can induce vibrations in the enclosure 102. The amplitude and frequency of the vibrations depends on the audio signal that drives the transducers 108, 110, as well as the structural design of the audio system 100 and the material characteristics of the materials used to form the audio system 100. Different portable devices can be more or less sensitive to different vibration frequencies.

The isolators 118 that couple the connector 114 through the chassis 106 of the cradle 104 to the enclosure 102 can substantially isolate the connector 114 and the cradle 104 from vibrations in the enclosure 102 created by the transducers 108, 110. It should be noted that there are two main vibration paths that can affect the portable device 116. The first path is through the connector 114 to the portable device 116. The second path is through the cradle 104 to the portable device 116. Some of the vibrations propagating through these two paths are directly coupled from the enclosure 102 to the isolators 118 and into the chassis 106. Other vibrations in the enclosure 102 propagate though the surface 158 and into the chassis 106. These vibrations are substantially attenuated by the feet 124 that are mechanically coupled to the enclosure 102. Any vibrations that are not completely attenuated by the feet 124 may propagate through the surface 158 and can be attenuated by the feet 120 before they can act upon the connector 114 or the cradle 104. The feet 120 can also attenuate vibrations in the surface 158 that emanate from external sources, such as sources that are in contact with the surface 158.

A portable device 116 that is placed in the cradle 104 and connected to the connector 114 is substantially isolated from the vibration, regardless of the propagation path of the mechanical energy. For example, a portable device 116 that includes a hard disk drive can be sensitive to external vibration. The vibration can interrupt an operation of the hard disk drive. The operation can include audio playback, accessing data from a memory, accessing data from a disk drive, recording data to a memory, recording data to a disk drive, recharging a battery in the portable device, or any other function of the portable device 116. The audio system 100 including the isolators 118 can isolate and attenuate vibrations that emanate from the enclosure 102 or from external sources before they can affect the operation of the portable device 116.

Figure 4:
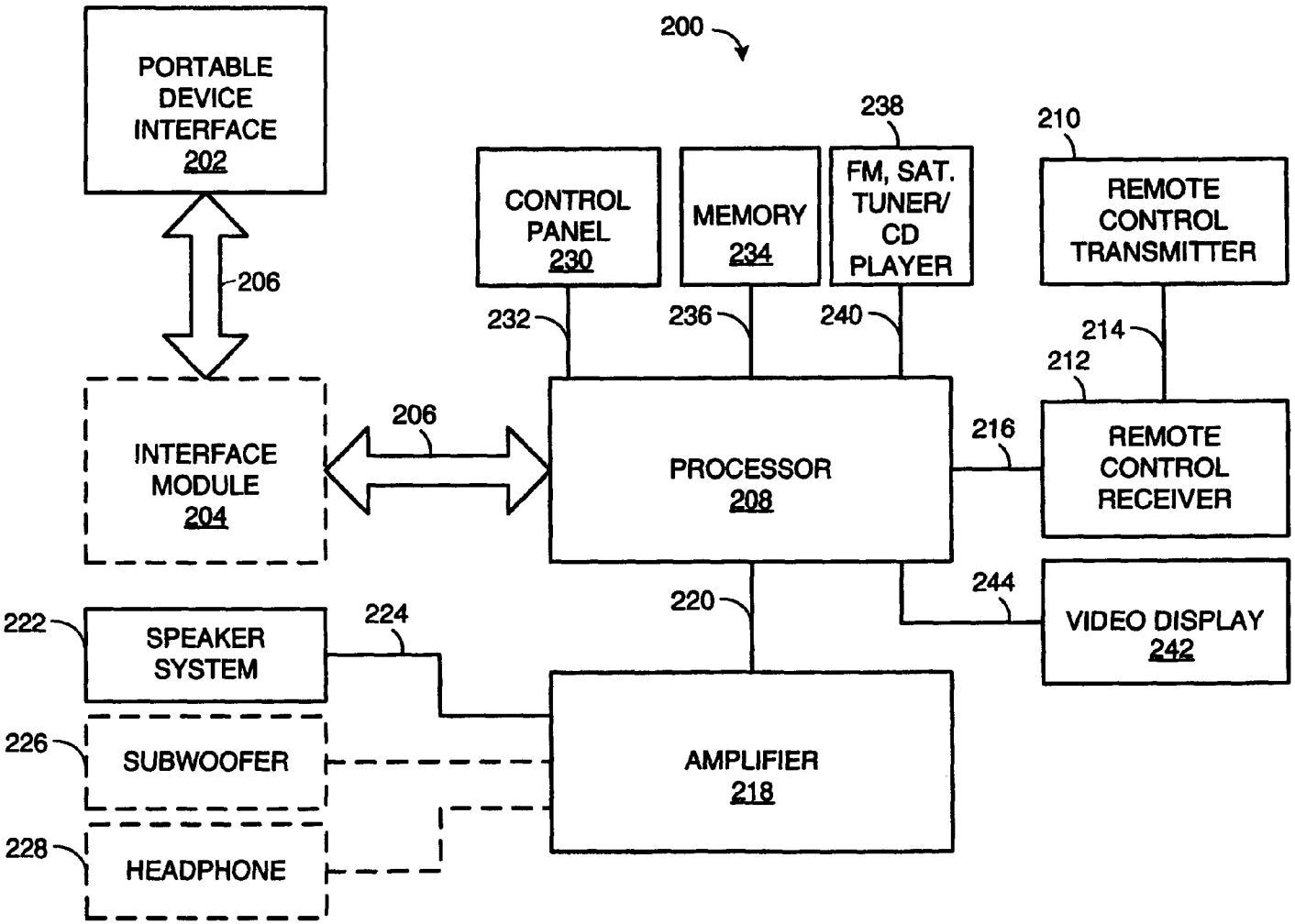
FIG. 4 illustrates a block diagram of the electrical system in the audio system of FIG. 1.

FIG. 4 illustrates a block diagram 200 of the electrical system in the audio system 100 of FIG. 1. The audio system 100 includes a portable device interface 202. The portable device interface 202 includes the connector 114 of FIG. 1. The connector 114 mates with the connector 115 (FIG. 1) of the portable device 116. Each unique portable device can have a different connector 115. The connector 114 of the audio system 100 can be replaced with another connector that is designed to mate with the connector of the unique portable device. The connector 114 includes a plurality of pins (not shown). Each of the pins is used to transmit various signals from the portable device 116 to the audio system 100 and vice versa. The number and arrangement of the pins in the connector 114 varies depending on the type of portable device 116 that is used with the audio system 100.

An output of the portable device interface 202 is coupled to an input of an optional interface module 204 through a bus 206. The bus 206 can be a bi-directional bus. In one embodiment, the optional interface module 204 is not included and the portable device interface 202 is coupled directly to a processor 208 through the bus 206. The portable device 116 generates output signals that are transmitted through the bus 206. For example, the output signals can include left and right channel audio signals, serial protocol signals, power and ground signals, and control signals. The portable device 116 can transmit any number of control and or data signals. In one embodiment, the data signals are analog signals.

The processor 208 can transmit commands to the portable device 116 through the bus 206. The commands can include balance, volume, equalization, audio track selection, fast forward, rewind, pause, play, skip audio tracks, shuffle audio tracks, customize play list, play random audio tracks, and/or any commands that the portable device 116 can recognize. The processor 208 can also transmit power and ground signals to the portable device 116 in order to provide power and/or to recharge a battery in the portable device 116.

The optional interface module 204 can be a hardware/software interface that accepts interface signals from various portable devices and modifies the signals to be compatible with the processor 208 in the docking station 100. The interface module 204 can be bi-directional. For example, the interface module 204 can modify commands to be compatible with the processor 208 and can also receive output commands from processor 208 and modify the output commands to be compatible with the portable device 116. Additionally, interface functions could be included in the system processor 208, therefore bypassing the need for a separate module.

The modification of the signals can include converting the signals from analog to digital signals or re-routing individual signals, for example. The optional interface module 204 can create an interface between any type of portable device and the processor 208, such that the processor 208 receives and understands input signals and commands from the specific portable device. The interface module 204 can include a processor, a switch, a random access memory (RAM), a read only memory (ROM), and/or any other required components.

A remote control transmitter 210 is coupled to a remote control receiver 212 through a communication link 214. The remote control transmitter 210 can be a radio-frequency (RF) transmitter, an infrared (IR) transmitter, or a hard-wired transmitter. The communication link 214 can be a wireless or a wired communication link depending on the requirements of the docking station 100. The remote control transmitter 210 can map functions of the portable device 116 so that a control switch on the remote control transmitter 210 corresponds to a similar control switch on the portable device 116. For example, if a control button on the portable device 116 corresponds to a "skip forward" function, the remote control transmitter 210 can be programmed to map the "skip forward" control button.

The remote control receiver 212 is coupled to the processor 208 through a communication link 216. Commands are transmitted from the remote control transmitter 210 to the remote control receiver 212 through the communication link 214. The processor 208 receives the commands from the remote control receiver 212 through the communication link 216. The commands can include the adjusting the volume, equalization, track selection, or any other commands that can control functions of the portable device 116 and/or the audio system 100.

In an embodiment that does not include the optional interface module 202, the processor 208 modifies or processes the command so that it is understood by the portable device 116. The processed command is then transmitted through the bus 206 to the portable device interface 202. The portable device 116 is connected to the connector 114 in the portable device interface 202. Upon receiving the command from the processor 208, the portable device 116 executes the command and transmits signals to the processor 208. For example, if the command from the processor relates to choosing a new audio track, the portable device 116 changes the audio track that is transmitted to the processor 208.

The processor 208 can modify an audio signal received from the portable device 116 by changing equalization or performing other signal processing on the audio signal. For example, the processor 208 can apply a dynamic range compression algorithm to the audio signal. The processor 208 can also perform other functions, such as sensing that a portable device 116 is connected to the connector 114 and energizing the audio system 100 in response to the connected portable device 116. The processor 208 can also place the audio system 100 in hibernation mode to conserve energy when it is not in use.

In one embodiment, the processor 208 can include a gain cell that modifies the gain of one or more frequencies in the audio signal. For example, the processor 208 can determine which predetermined frequencies in the audio signal contribute to vibrations in the enclosure 102 that have the largest detrimental effect on the connected portable device 116. In one embodiment, known frequencies that contribute to vibrations that affect the portable device are predetermined and stored in a lookup table and the processor 208 adjusts the gain cell in response to those known frequencies. For example, the processor 208 can reduce the gain of certain frequencies of the audio signal, thereby reducing the maximum output from the transducers 108, 110 for those frequencies.

In one embodiment, the processor 208 can include a notch filter to minimize the output of certain frequencies of the audio signal. Other forms of signal processing can also be used to reduce the gain of certain frequencies that contribute to vibrations that are detrimental to the portable device 116. Other gain cell and notch filter approaches for reducing the effect of mechanical vibrations are described in more detail in U.S. Pat. No. 6,067,362, entitled Mechanical Resonance Reducing which is assigned to the assignee of the present application. The entire disclosure of U.S. Pat. No. 6,067,362 is incorporated herein by reference. The notch filter approach used in the above-referenced patent is different from the embodiment described above. The notch filter used in the above-referenced patent is used to form a frequency dependent limiter. That is, the notch filter determines the maximum allowable level at each frequency that can be applied. However, as long as no frequency component is above this level, there will be no filtering present in the signal path. The filtering performed by the notch filter is signal level dependent.

The processor 208 transmits the audio signal to an amplifier 218 through a communication link 220. The amplifier 218 amplifies the audio signal. In one embodiment, the processor 208 can increase the gain of an audio signal gradually so that a user can become accustomed to the audio signal before it reaches a desired amplification level. For example, this ramping behavior can occur when the portable device 116, playing audio data, is connected to the audio system 100. The processor 208 determines that a portable device 116 has been connected to the audio system and slowly increases the gain of the amplifier 218. The processor 208 can adjust the gain of the amplifier 218 in different increments. Any amplifier that can amplify the audio signal can be used. For example, the amplifier 218 can be a class-A, A/B, C, D, G, or H amplifier or any other known amplifier. In another embodiment, the processor 208 alters the gain of a digital audio signal directly, by performing a multiplication on the signal.

The processor 208 can also adjust the equalization of the portable device 116. For example, when the portable device 116 is connected to the audio system 100, the processor 208 can issue a command to the portable device 116 to reset its signal processing parameters (e.g., parameters associated with tone controls, equalization settings, dynamic equalization, or other signal processing functions) to predetermined settings, such as nominal settings. This can prevent the portable device 116 from adding significant undesirable equalization (or other processing) to the audio signal. In other embodiments, the processor 208 can apply predetermined parameter settings to the portable device 116 when it is connected to the audio system 100.

An output of the amplifier 218 is coupled to a speaker system 222 in the docking station 100 through a communication link 224. The speaker system 222 can include the transducers 108, 110 of FIG. 1. The speaker system 222 can include any number or type of transducers including passive radiators, woofers, tweeters, piezoelectric, electrostatic, horn-type, or planar magnetic speakers.

An output of the amplifier 218 can be coupled to an optional subwoofer 226. The subwoofer 226 can be a powered subwoofer. Another output of the amplifier 218 can be coupled to an optional headphone 228. The audio system 100 (FIG. 1) can include any number of input/output ports that are coupled to the processor 208 or the amplifier 218 for linking to various external devices, such as stereo systems, audio/video players, headphones, speaker systems, personal computers, cellular telephones, personal digital assistants (PDAs), televisions, and/or set top boxes.

A control panel 230 can be mounted to the docking station 100. The control panel 230 is electrically coupled to the processor 208 through a communication link 232. The control panel 230 can include control knobs, a keypad, a touchpad, switches, a liquid crystal display, a touch screen, or any other device that can control functions of the audio system 100 and the portable device 116. The control panel 230 and the remote controller 210 can include the same or different controls, or can include some common control functions.

A memory 234 can also be electrically coupled to the processor 208 through a communication link 236. The memory 234 can be a RAM, ROM, disk drive, flash memory, EPROM, or any other suitable type of memory. The memory 234 can store parameters or settings of the audio system 100 and/or the portable device 116. In one embodiment, the memory 234 can buffer audio data. The memory 234 can also be used to store entire audio tracks that can be played through the audio system 100. The stored audio tracks can also be transferred and/or saved to the portable device 116.

An external tuner/CD player 238, such as an AM, FM, or satellite tuner, or a portable CD player can be electrically coupled to the processor 208 through a communication link 240. The external tuner/CD player 238 can be used to play audio signals through the audio system 100. Other devices, such as minidisk players, cassette players, or digital audio tape (DAT) players can also be used. In one embodiment (not shown), a radio tuner and/or a CD player are integrated directly into the audio system 100.

In one embodiment, the audio system 100 can include multimedia capability. In this embodiment, a video display 242 is coupled to the processor 208 through a communication link 244. The video display 242 can be a liquid crystal display (LCD), a light emitting diode (LED) display, a plasma display, a cathode ray tube (CRT) display, or any other suitable display device. The portable device 116 can be a digital camera, a video camera, a cellular telephone with digital picture capability, a portable video player, or a portable DVD player, for example. The portable device 116 can transmit an audio signal and/or a video signal to the processor 208. The processor 208 processes the audio signal and the amplifier 218 amplifies the processed audio signal. The processor 208 can also process the video data and transmit the video signal to the video display 242. The video data processing can include color balance control, brightness control, contrast control, aspect ratio control, format conversion, or any other video control parameter. The audio system 100 with video capability can include surround sound capability. The surround sound capability can be achieved by using one or more transducers that are internal and/or external to the audio system 100.

Figure 5:
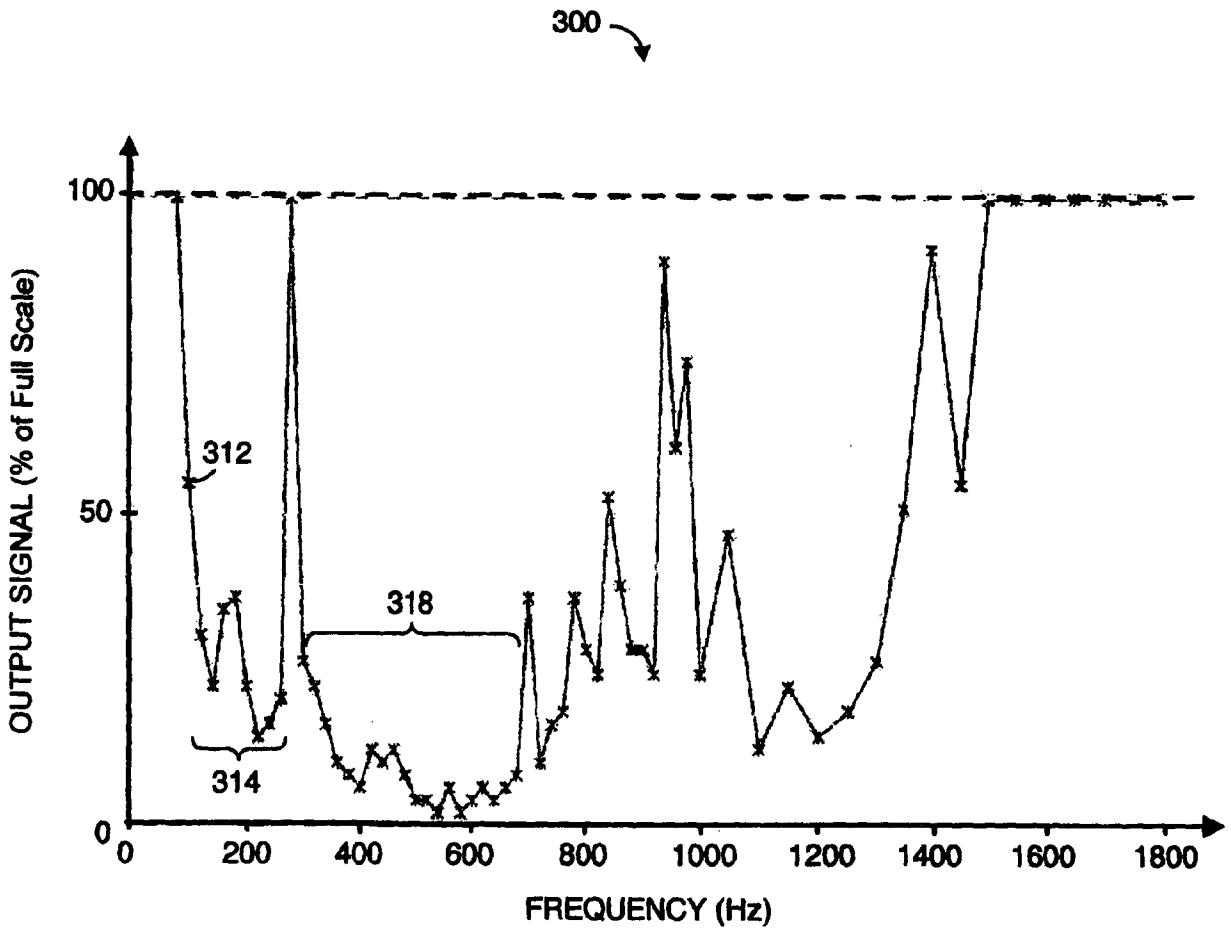
FIG. 5 illustrates a graph of interruptions in an operation of a portable device connected to a docking station as a function of frequency of a signal applied to transducers mounted in a typical speaker enclosure.

FIG. 5 illustrates a graph 300 of interruptions in an operation of a portable device 116 connected to a docking station as a function of frequency of a signal applied to transducers 108, 110 mounted in a typical speaker enclosure. The portable device 116 is mechanically coupled to the typical speaker enclosure without the isolators 118 (i.e. the cradle/chassis assembly is rigidly connected to the enclosure). Thus, the portable device 116 is not vibrationally isolated from the speaker enclosure. In this example, the portable device 116 includes a hard disk drive. The operation of the hard disk drive can be interrupted by vibrations having specific frequencies and amplitudes. The graph 300 shows the maximum level of signal as a function of frequency that can be applied to transducers 108, 110 without causing an interruption of the audio output provided by a hard disk drive-based portable device 116 connected to the docking station.

At frequencies of less than about 100 Hz, the maximum available signal can be applied to transducers 108, 110 without causing an interruption of the signal provided by the portable device. At a frequency of about 100 Hz, the maximum amplitude 312 of the applied signal is about fifty percent of maximum before the operation of the disk drive is interrupted by the vibrations generated by the transducers 108, 110.

At frequencies between about 100 Hz and 300 Hz, maximum amplitudes 314 of the applied signals reach less than about fifty percent before the operation of the disk drive is interrupted by the vibrations generated by the transducers 108, 110. At a frequency of about 300 Hz, the maximum available signal can be applied to the transducers 108, 110 without causing an interruption of the signal provided by the portable device 116. At frequencies between about 300 Hz and 650 Hz, maximum amplitudes 318 of the applied signals reach less than about fifty percent before the operation of the disk drive is interrupted by the vibrations generated by the transducers 108, 110. FIG. 5 illustrates that the operation of the disk drive is significantly interrupted by the vibration generated by the transducers 108, 110, over a large frequency range, for applied signal levels significantly less than the maximum signal level that could be applied by the system.

Figure 6:
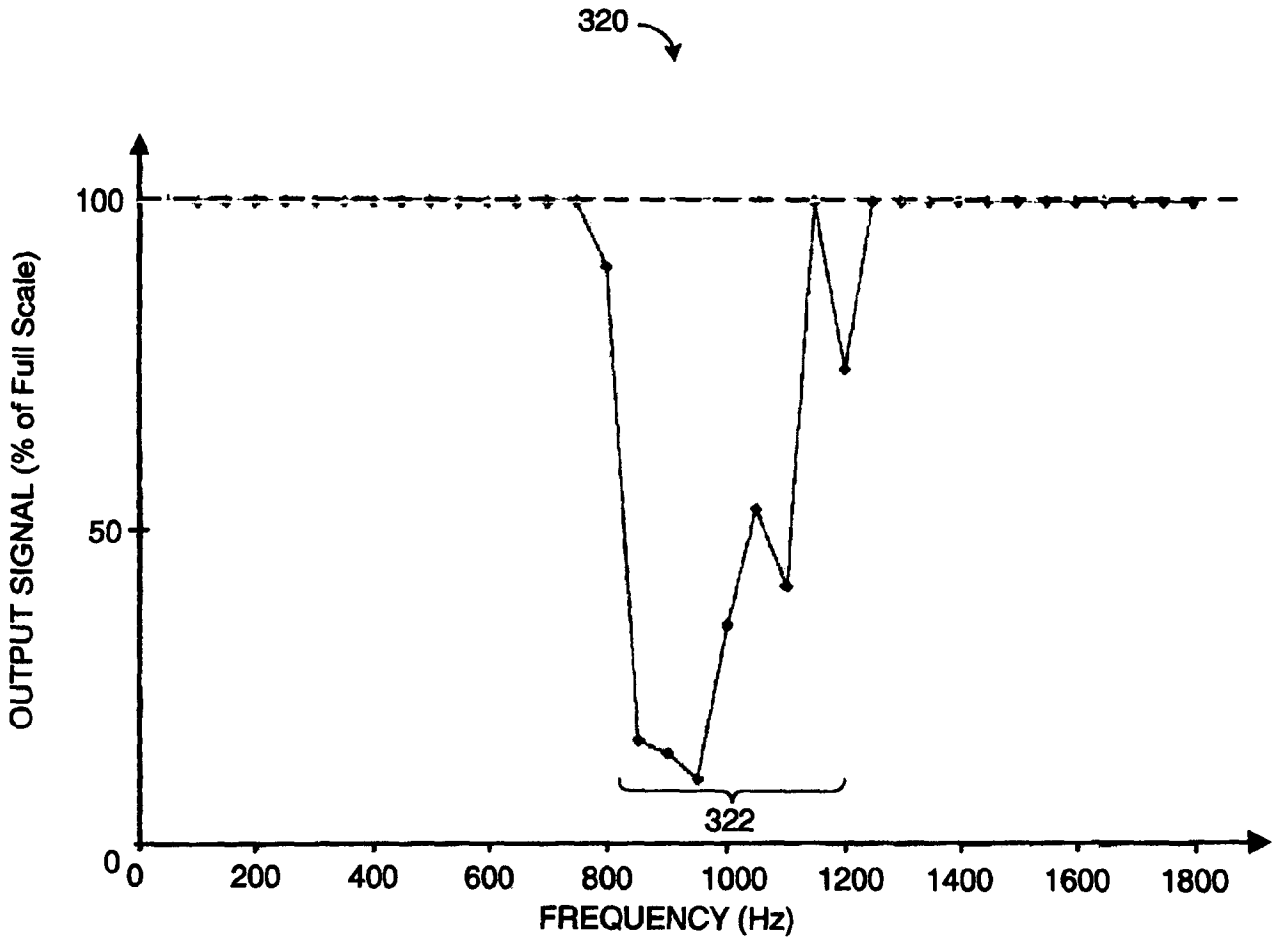
FIG. 6 illustrates a graph of interruptions in an operation of a portable device connected to an audio system as a function of frequency of a signal applied to transducers mounted in the audio system of the present invention.

FIG. 6 illustrates a graph 320 of interruptions in an operation of a portable device 116 connected to an audio system 100 (FIG. 1) as a function of frequency of a signal applied to transducers 108, 110 mounted in the audio system 100 of the present invention. The portable device 116 is connected to the cradle 104 and the connector 114 which is mechanically coupled to the enclosure 102 through the isolators 118 (i.e., the chassis 106 of the cradle 104 is isolated from the enclosure 102). Thus, the portable device 116 is vibrationally isolated from the enclosure 102. In this example, the portable device 116 includes a hard disk drive.

At frequencies of less than about 100 Hz to about 800 Hz, the maximum available signal can be applied to transducers 108, 110 without causing an interruption of the signal provided by the portable device 116. At frequencies between about 800 Hz and 1250 Hz, the amplitudes 322 of the applied signals reach less than about fifty percent before the operation of the disk drive is interrupted. At these frequencies, acoustic excitation of the portable device 116 is responsible for the interruptions in the operation of the disk drive and not mechanical vibrations emanating from the transducers 108, 110. At frequencies of above about 1250 Hz, the maximum available signal can be applied to transducers 108, 110 without causing an interruption of the signal provided by the portable device 116.

FIG. 6. illustrates a considerable improvement in the occurrences of interruptions in the portable device 116 compared to the occurrences of interruptions in the portable device 116 shown in FIG. 5. This is because the cradle assembly 105 (FIG. 1) mechanically couples the portable device 116 to the enclosure 102 through the isolator 118. The isolator 118 reduces an amplitude of the coupled vibration so that an operation of the portable device within a portion of the frequency range of the signal is uninterrupted when the portable device 116 is coupled to the cradle assembly 105. In one embodiment, the portion of the frequency range can be between about 10 Hz and 800 Hz or between about 1200 Hz and 20 kHz, for example. The portion of the frequency range can be different for different portable devices and depends on the vibration sensitivity of the particular portable device.

It should be noted that the graph 300 of FIG. 5 and the graph 320 of FIG. 6 are generated using devices having similar output characteristics and the same maximum output level capability. Thus, the relative output level as a function of frequency for each device is the same.

Figure 7:
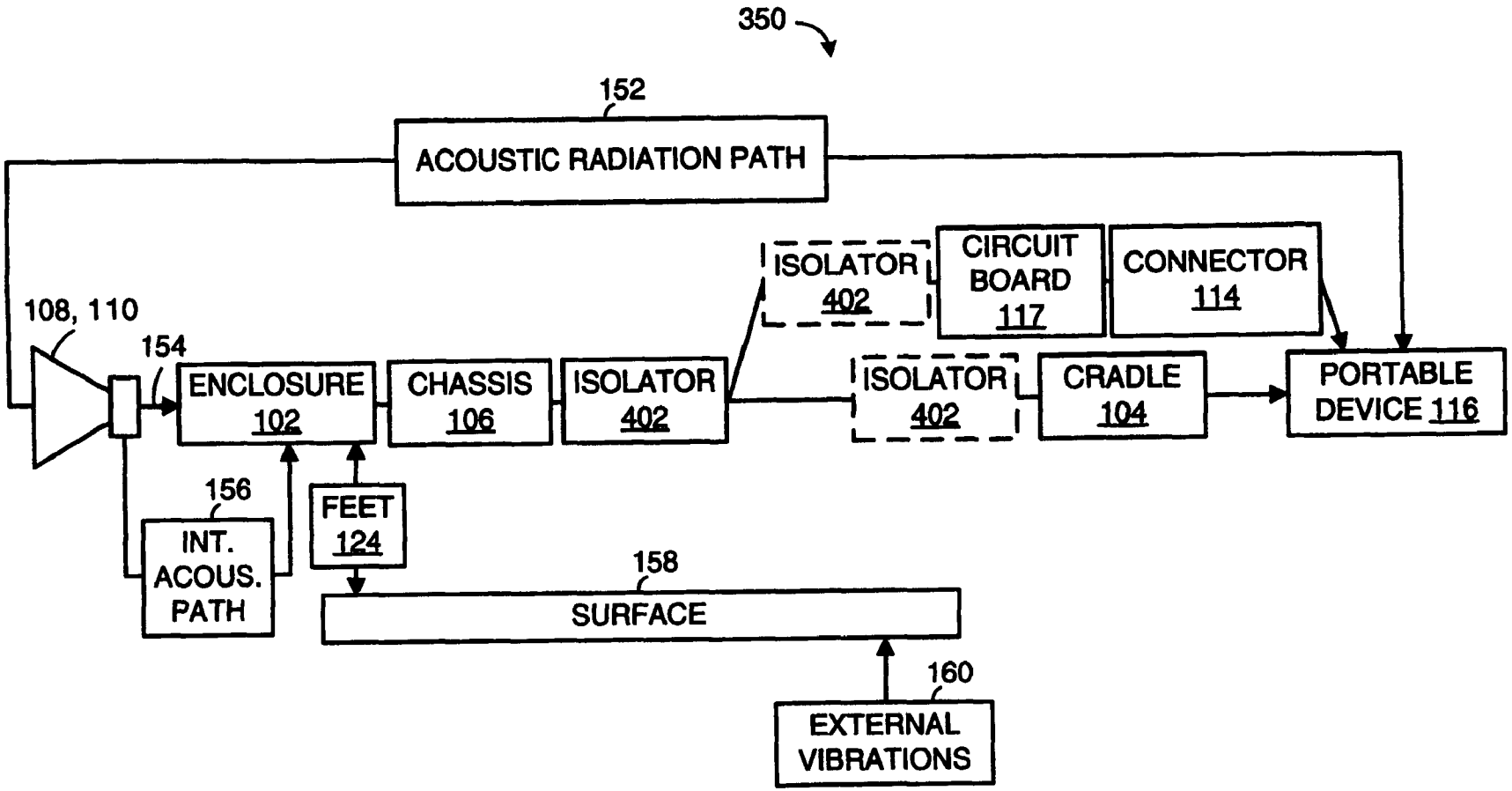
FIG. 7 illustrates a block diagram of the transmission path of vibrations in an audio system according to another embodiment of the invention.
Figure 8:
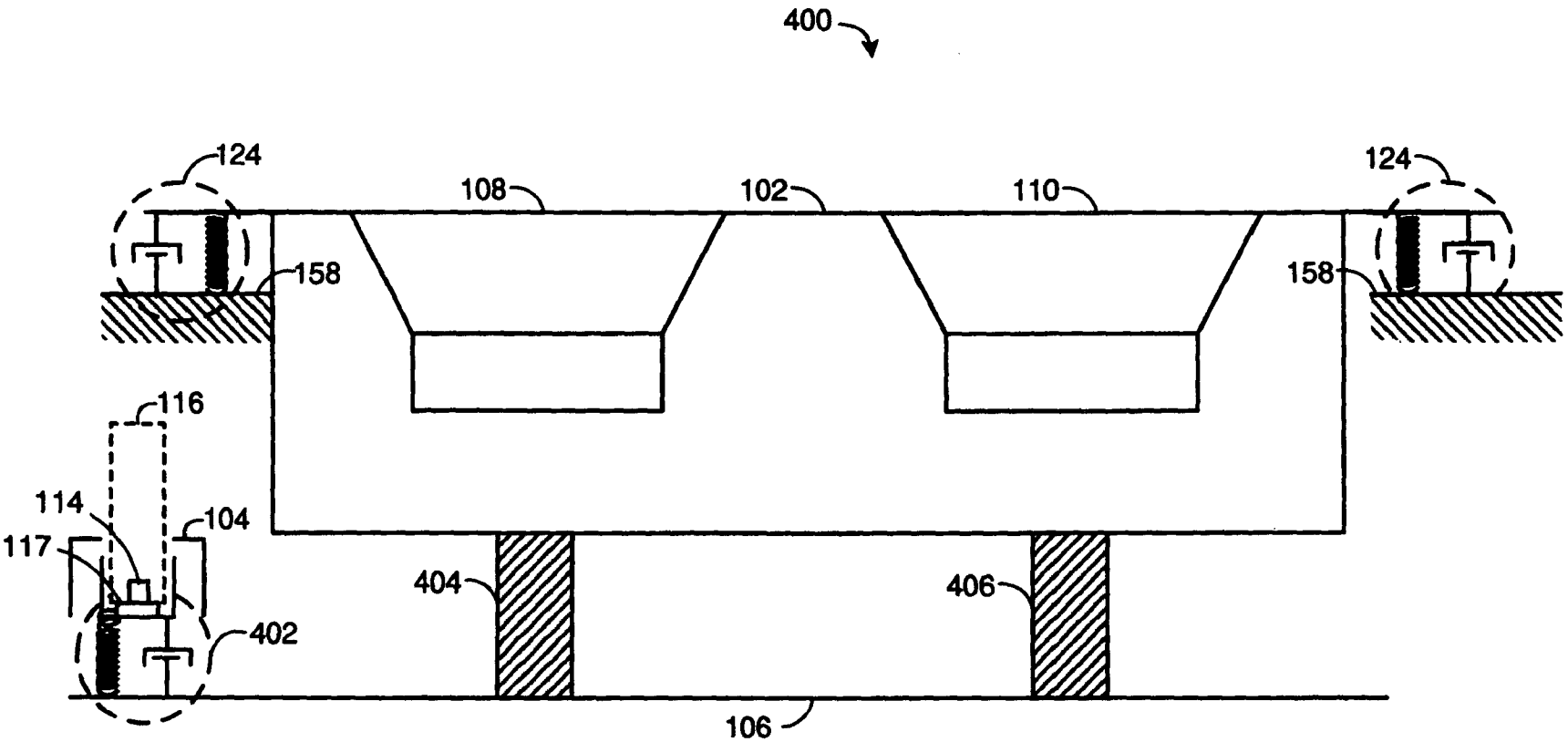
FIG. 8 illustrates a schematic diagram of an audio system according to another embodiment of the invention.

FIG. 7 illustrates a block diagram of the transmission path 350 of vibrations in an audio system 400 according to another embodiment of the invention. One embodiment of the audio system 400 is shown in FIG. 8. The vibrations that can affect the portable device 116 in the audio system 400 can be separated into the three distinct paths described with reference to FIG. 2.

The first vibration path 152 is generated by the acoustic output of the transducers 108, 110 in the form of sound waves. The portable device 116 is generally not isolated from the acoustic output of the transducers 108, 110. The second vibration path 154 is generated by the mechanical movement of the transducers 108, 110 in the enclosure 102. The enclosure 102 can also experience vibrations generated from within the enclosure 102 from the internal acoustic vibration path 156 created by the acoustic output of the transducers 108, 110 within the enclosure 102. Pressure within enclosure 102 applies forces to the enclosure walls, inducing mechanical vibration in the walls.

The enclosure 102 is mechanically coupled to the surface 158 by the feet 124. The feet 124 are designed to attenuate vibrations that emanate from the enclosure 102 before they are transmitted to the surface 158. The feet 124 can also attentuate vibrations that emanate from the surface 158 before they are transmitted to the enclosure 102.

In the embodiment described by FIG. 7, the chassis 106 of the cradle 104 is rigidly mounted to the enclosure 102. The second vibration path 154 is interrupted by one or more isolators 402. The isolators 402 are positioned between the chassis 106 and the combination of the cradle 104 and the circuit board 117/connector 114. It should be noted that the isolator 402 could connect to the PCB 117 directly, the cradle 104 directly, or both. It typically connects to the cradle 104 directly. In this embodiment, the circuit board 117 is rigidly mounted to the cradle 104. The isolators 402 are designed to prevent vibrations emanating from the enclosure 102 from coupling into the cradle 104. The isolators 402 isolate the cradle 104 and the circuit board 117/connector 114 from the chassis 106 and the enclosure 102 and attentuate vibrations before they can affect the operation of the portable device 116.

The portable device 116 is mechanically and electrically coupled to the connector 114. The portable device 116 is also mechanically coupled to the cradle 104. The cradle 104 provides physical support to the portable device 116 when it is seated onto the connector 114.

FIG. 8 illustrates a schematic diagram of an audio system 400 according to another embodiment of the invention. The audio system 400 includes the enclosure 102 and the cradle 104. A chassis 106 of the cradle 104 is mechanically coupled to the enclosure 102 of the audio system 400 through rigid members 404, 406. The enclosure 102 is shaped to include the transducers 108, 110. The transducers 108, 110 are generally rigidly mounted to the enclosure 102.

In one embodiment, the transducers 108, 110 are mounted into apertures in the enclosure 102 using screws or other mounting hardware. A gasket or other sealing device can be placed between a basket or frame of each of the transducers 108, 110 and its corresponding aperture in the enclosure 102.

The cradle 104 includes the circuit board 117. The circuit board 117 includes the connector 114 that is shaped to connect to the connector 115 of the portable device 116. The connector 114 is mechanically coupled to circuit board 117 which is mechanically coupled to the cradle 104. The cradle 104 is mounted to the chassis 106 through one or more of the isolators 402. The cradle 104 generally surrounds the connector 114. The cradle 104 and the connector 114 can be exchanged with other cradles and connectors to allow a variety of portable devices to be used with the audio system 400.

The isolators 402 isolate the cradle 104 and the connector 114 from the chassis 106 and the enclosure 102. The isolators 402 can be springs, elastomer members, foam members, cork members, dashpots, shock absorbers, hydraulic systems, cushions, grommets, bushings, or any suitable mechanical filter element.

In one embodiment, the isolators 402 are grommets that are fabricated from rubber, elastomer, or silicon material. The isolators 402 can be fabricated from a urethane compound that exhibits good damping characteristics and stable material properties over a broad temperature range. The mass and size of the portable device 116, as well as the shear and compressive loading encountered from connecting the portable device 116 to the connector 114 determine the number, position, and type of isolators 402 that are used. Vibrations from the enclosure 102 can be directly coupled into the chassis 106. Thus, the isolators 402 between the cradle 104 and the chassis 106 should be able to attenuate the vibrations emanating from the enclosure 102 before they propagate to the cradle 104 and the connector 114.

The enclosure 102 of the audio system 400 can also include the feet 124 that are positioned to support the audio system 400 when it is placed on surface 158. The feet 124 can be fabricated from a rubber, elastomer, or silicon material. The feet 124 substantially filter or attenuate vibration emanating from the enclosure 102 that can propagate into the surface 158.

Figure 9:
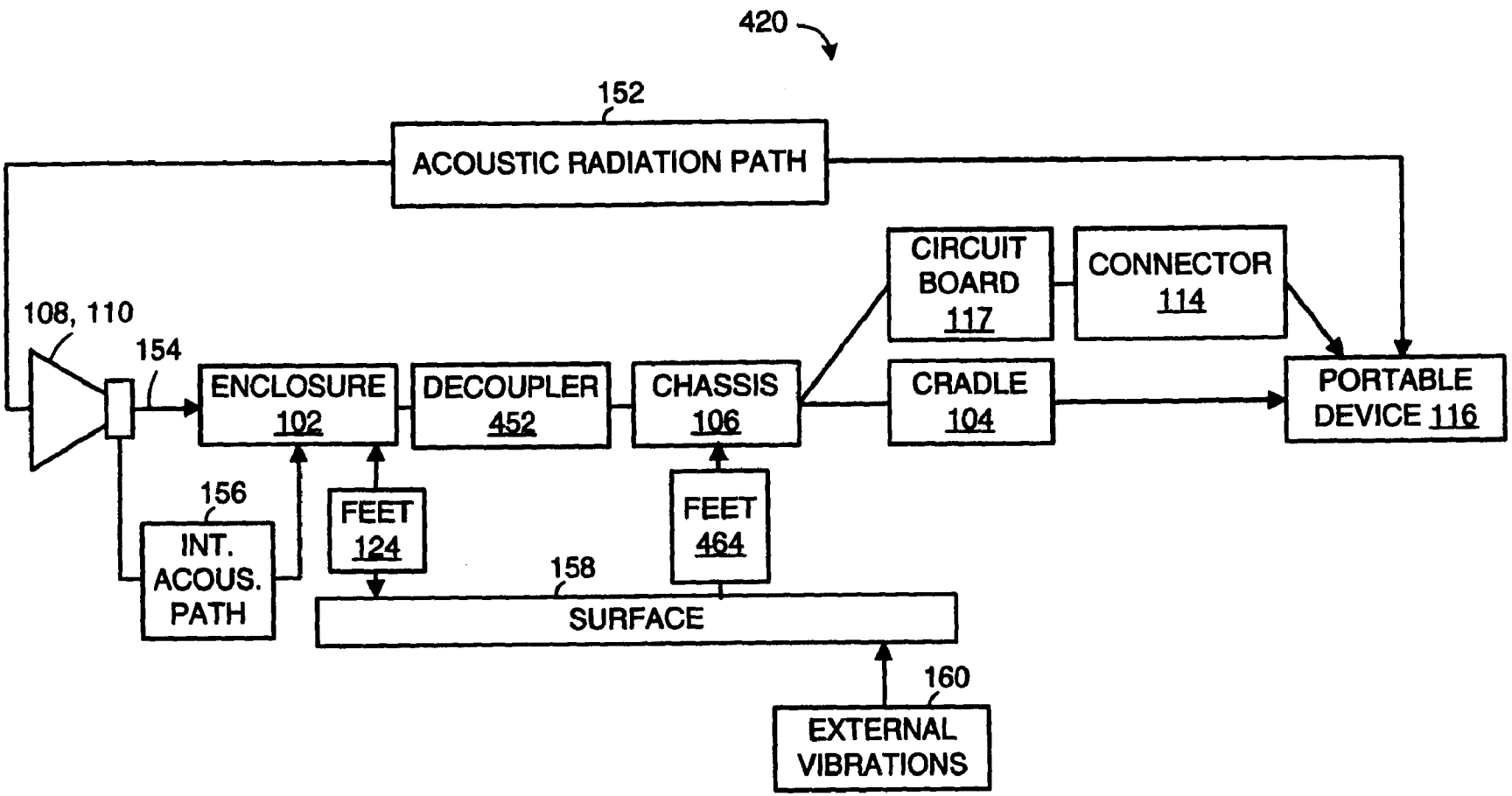
FIG. 9 illustrates a block diagram of the transmission path of vibrations in an audio system according to another embodiment of the invention.
Figure 10:
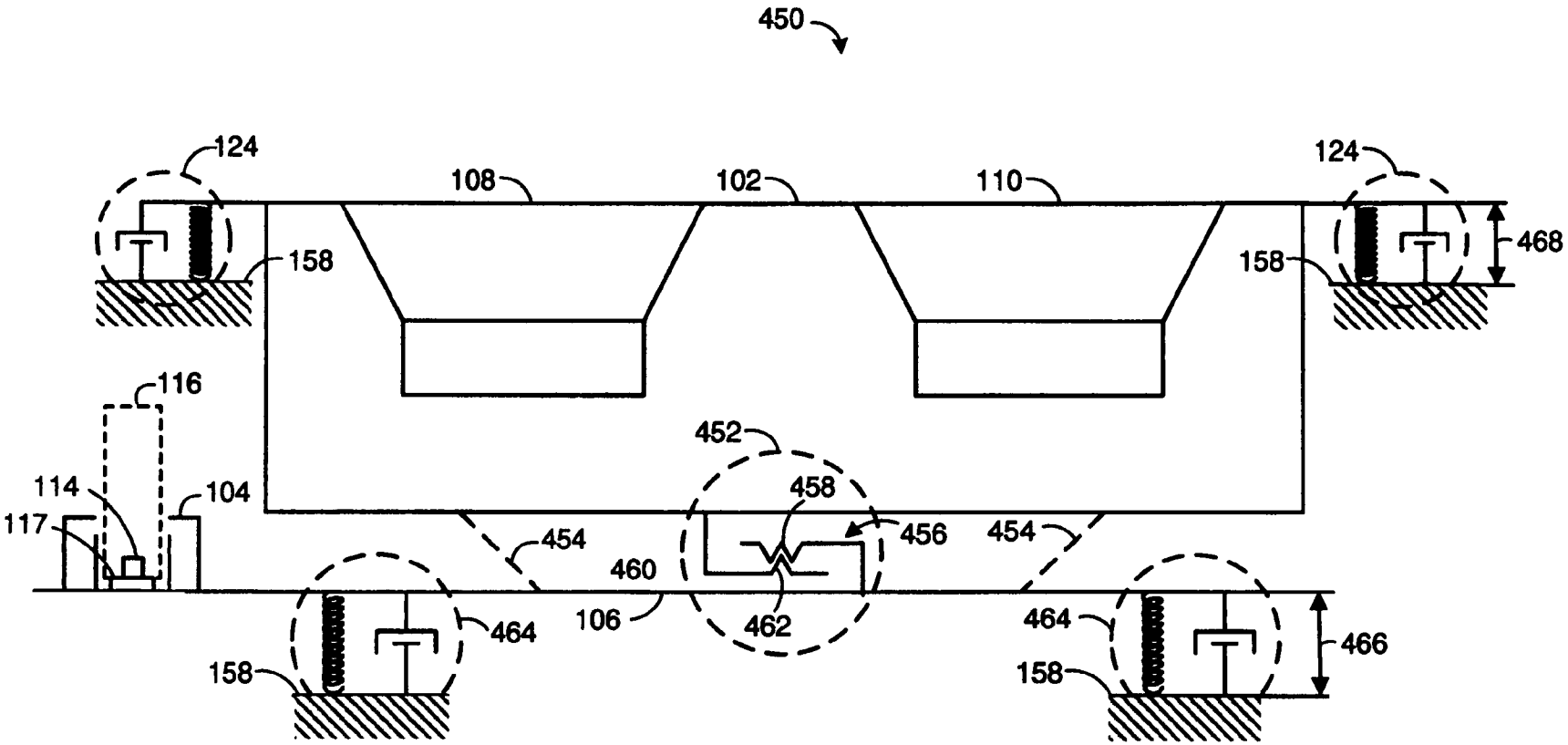
FIG. 10 illustrates a schematic diagram of an audio system according to another embodiment of the invention.

FIG. 9 illustrates a block diagram of the transmission path 420 of vibrations in an audio system 450 according to another embodiment of the invention. One embodiment of the audio system 450 is shown in FIG. 10. The vibrations from the enclosure 102 that can affect the portable device 116 in the audio system 420 can be substantially decoupled.

The enclosure 102 is mechanically coupled to the surface 158 by the feet 124. The feet 124 are designed to attenuate vibrations that emanate from the enclosure 102 before they are transmitted to the surface 158. The feet 124 can also attentuate vibrations that emanate from the surface 158 before they are transmitted to the enclosure 102. The chassis 106 is mechanically coupled to the surface 158 by the feet 464. The feet 464 are designed to attenuate vibrations that emanate from the enclosure 102 and propagate through the surface 158 before they are transmitted to the chassis 106 of the cradle 104.

In the embodiment shown, the chassis 106 of the cradle 104 is separated from the enclosure 102 by a decoupler 452. The second vibration path 154 is thus interrupted by the decoupler 452. The decoupler 452 is designed to prevent vibrations emanating from the enclosure 102 from coupling into the chassis 106 of the cradle 104. The decoupler 452 can include an alignment mechanism which is described in more detail herein.

FIG. 10 illustrates a schematic diagram of an audio system 450 according to another embodiment of the invention. The audio system 450 includes the enclosure 102 and the cradle 104. The chassis 106 of the cradle 104 is physically separated from the enclosure 102 by the decoupler 452. The only mechanical connection from the chassis 106 to the enclosure 102 is through one or more tethers 454. The tethers 454 substantially tether the chassis 106 of the cradle 104 to the enclosure 102 in order to prevent the cradle 104 from completely disengaging from the audio system 450. The tethers 454 can also substantially prevent the cradle 104 from moving laterally with respect to the enclosure 102. In some embodiments, the tethers 454 are fabricated from elastomer, paper, plastic, metal, rubber, fabric, or any other suitable material. For example, the tethers 454 can be rubber bands, O-rings, string, fabric bands, springs, or wires.

The enclosure 102 is shaped to include one or more transducers 108, 110. In one embodiment, the transducers 108, 110 are mounted into apertures in the enclosure 102 using screws or other mounting hardware.

The connector 114 is mechanically coupled to the circuit board 117 which is rigidly mounted to the chassis 106 of the cradle 104. The cradle 104 generally surrounds the connector 114. The connector 114 can be integrated with the cradle 104 or molded into the cradle 104. The shape and size of the cradle 104 are generally variable to accommodate a variety of portable devices 116.

The decoupler 452 is positioned to physically separate the chassis 106 of the cradle 104 from the enclosure 102 when the audio system 450 is placed on the surface 158. The decoupler 452 can include an alignment mechanism 456 that aligns the chassis 106 of the cradle 104 to the enclosure 102 when the audio system 450 is moved. The alignment mechanism 456 includes a top portion having an alignment feature 458. The alignment mechanism 456 also includes a bottom portion having a mating feature 462 that mates with the alignment feature 458 in the top portion. The alignment feature 458 in the top portion engages the mating feature 462 in the bottom portion when the audio system 450 is removed from the surface 158.

The enclosure 102 of the audio system 450 can also include one or more feet 124 that are positioned to support the audio system 450 when it is placed on the surface 158. The chassis 106 which is physically separated from the enclosure 102 though the decoupler 452 can also include one or more feet 464 that are positioned to support the chassis 106 when the audio system 450 is placed on the surface 158. In one embodiment, the height 466 of the feet 464 under the cradle 104 is greater than the height 468 of the feet 124 under the enclosure 102. In this embodiment, the chassis 106 of the cradle 104 is substantially physically separated from the enclosure 102 when the audio system 450 is positioned on the surface 158. The tethers 454 are substantially in a relaxed state, and thus, do not propagate vibrations that emanate from the enclosure 102 to the chassis 106.

The feet 464 can substantially attenuate any vibrations that emanate from the enclosure 102 and travel through the surface 158 before they can propagate to the chassis 106 and ultimately to the connector 114. The feet 464 substantially attenuate the vibrations by interrupting the propagation of the vibration before the vibration can reach the connector 114 as previously described. In one embodiment, the feet 464 can also substantially attenuate vibrations emanating from external sources (not shown) that are in contact with the surface 158.

Equivalents

While the invention has been particularly shown and described with reference to specific preferred embodiments, it should be understood by those skilled in the art that various changes in form and detail may be made therein without departing from the spirit and scope of the invention as defined herein.

What is claimed is:

1. An audio system for reproducing sound stored on a memory in a portable device having a device connector comprising:

a) an enclosure;

b) a transducer that is mounted to the enclosure, the transducer creating a vibration in the enclosure in response to being driven by an audio signal; and c) a cradle assembly that mechanically couples the portable device to the enclosure through one or more isolators such that only a portion of the vibration is coupled to the portable device and having a cradle connector connectable to the device connector for receiving an audio signal stored on the memory, the enclosure being supported substantially entirely by the cradle assembly which releasably supports the portable device, the one or more isolators being interposed between the enclosure and a surface on which the system is placed such that only a portion of the vibration is coupled to the surface.

2. The audio system of claim 1 wherein an operation of the portable device comprises at least one of audio playback, accessing data from a memory, accessing data from a disk drive, recording data to a memory, recording data to a disk drive, and recharging a battery.

3. The audio system of claim 1 wherein the enclosure further comprises at least one of an acoustic port, an acoustic waveguide, a passive radiator, an acoustic insulator, and an acoustic dampening device.

4. The audio system of claim 1 wherein the enclosure further comprises at least one foot.

5. The audio system of claim 1 further comprising a remote control receiver that receives a signal that controls a function of the portable device.

6. The audio system of claim 5 further comprising a remote control transmitter that generates the signal.

7. The audio system of claim 6 wherein the remote control transmitter communicates with the remote control receiver through a wireless communication link.

8. The audio system of claim 6 wherein the remote control transmitter further comprises control buttons that are mapped to control buttons on the portable device.

9. The audio system of claim 1 wherein the isolator comprises at least one of an elastomer member, a spring, a foam member, a cork member, a dashpot, a shock absorber, a hydraulic system, a cushion, a grommet, and a bushing.

10. The audio system of claim 1 wherein the cradle assembly further comprises a connector that electrically couples the portable device to the transducer.

11. The audio system of claim 1 wherein the cradle assembly further comprises an insert that is shaped to accept a chassis of the portable device.

12. The audio system of claim 1 wherein the cradle assembly further comprises an elastomer member that isolates a chassis of the portable device from the cradle assembly.

13. The audio system of claim 1 wherein the cradle assembly further comprises at least one foot.

14. The audio system of claim 1 wherein the isolator reduces an amplitude of at least a portion of the vibration coupled into the portable device so that the portable device provides an uninterrupted data stream to the audio system when the portable device is connected to the cradle assembly.

15. The audio system of claim 1 wherein operation of the portable device is uninterrupted when the transducer is creating vibrations in the range of about 1200 Hz to about 20 kHz.

16. The audio system of claim 1 wherein the portable device comprises at least one of an MP3 device, a mini-disk device, a compact disk (CD) device, a personal digital assistant (PDA), a palmtop computer, a cellular telephone, a digital camera, and a pager.

17. The audio system of claim 1 wherein the portable device comprises a disk drive.

18. The audio system of claim 1 wherein the portable device comprises a portable audio player.

19. The audio system of claim 1 further comprising a processor that processes the audio signal.

20. The audio system of claim 19 wherein the processor comprises a gain cell that modifies a gain of one or more predetermined frequencies in the audio signal.

21. The audio system of claim 19 wherein the processor comprises a notch filter that modifies a gain of one or more predetermined frequencies in the audio signal.

22. The audio system of claim 19 wherein the processor comprises a notch filter that is tuned to one or more predetermined frequencies in the audio signal that correspond to vibrations in the enclosure that can interrupt the operation of the portable device.

23. The audio system of claim 19 further comprising an interface module that modifies a signal from the portable device and transmits the modified signal to the processor.

24. The audio system of claim 19 wherein the processor increases a gain of the audio signal in predetermined increments when the portable device is coupled to the audio system.

25. The audio system of claim 19 wherein the processor presets an equalization parameter of the portable device to a predetermined setting.

* * * * *